United States Patent [19]

Chambley et al.

[11] 4,114,549

[45] Sep. 19, 1978

[54] PILE FABRIC

[75] Inventors: Phillip W. Chambley; Alan H. Norris, both of Rome, Ga.

[73] Assignee: Champion International Corporation, Stamford, Conn.

[21] Appl. No.: 804,307

[22] Filed: Jun. 7, 1977

[51] Int. Cl.[2] ..... D02G 3/26; D05C 17/02

[52] U.S. Cl. ..... 112/410; 57/34 AT; 57/140 R

[58] Field of Search ..... 57/34 AT, 140 R; 139/399–401; 112/410–411

[56] References Cited

U.S. PATENT DOCUMENTS

| | | | |
|---|---|---|---|
| 2,961,010 | 11/1960 | Berry | 57/34 AT |
| 3,434,275 | 3/1969 | Backer et al. | 57/34 AT |
| 3,443,370 | 5/1969 | Wales | 57/34 AT |
| 3,775,955 | 12/1973 | Shah | 57/34 AT |

*Primary Examiner*—Charles Gorenstein
*Attorney, Agent, or Firm*—Evelyn M. Sommer

[57] ABSTRACT

A pile fabric, which may be used, for example, in carpets and in terry toweling, comprises a backing and a pile of plied yarns and singles yarns, each of the plied yarns consisting of two or more single yarns which are individually twisted by vortex jet air devices to form an alternating pattern of "S" twists and "Z" twists along their lengths. The singles yarns are joined at their nodes to form a plied yarn in which the spacing between the nodes may be selected to give an increased yarn bulk and with the singles yarns between the nodes false twisted in the same direction, the singles having either an "S" or a "Z" twist. The singles yarn between the fastened nodes are permitted to self-twist together in the opposite direction as the twist direction of the singles yarns, forming a stable self-twisted plied yarn.

9 Claims, 5 Drawing Figures

PILE FABRIC

BACKGROUND OF THE INVENTION

The present invention relates to pile fabrics and more particularly to a pile fabric in which the yarn is a texturized yarn which is a stable plied yarn which is formed by self-twisting from a plurality of false twisted single yarns and joined at the nodes of the single false twisted yarns.

The use of artificial "man-made" fibers, as a replacement for natural fibers such as wool and cotton, is increasingly widespread. The use of artificial fibers is especially widespread in carpet manufacture where their ease of care, durability, lightweight strength and resistance to weather exposure, sunlight, chemicals, moths and other insects, along with color-fastness of such fibers, pose distinct advantages.

However, one drawback with artificial fibers is that they do not, without special processing, possess the bulk associated with wool.

Another difficulty with carpets of artificial fibers may be a tendency to "streak" or form lines which detract from the carpet's appearance. Such streaking may be due to the pile loops or tufts forming into a somewhat parallel alignment, giving a directional effect. Such streaking can be caused by twist variations between tufts, certain constructions accentuating the optical effects of such twist variations. In some cases if the singles and plied yarns of the carpet are uniformly twisted in one direction, the tendency toward parallel alignment and streaking may be more pronounced.

Generally speaking, as methods to add bulk or other desirable properties to yarn, false-twisting and self-twisting and the yarns thereby produced have received considerable attention in recent years and reference is made to the following documents in which these yarns, the techniques for producing them, and specific apparatus related thereto are discussed:

"Self-Twist Yarn", D. E. Henshaw Merrow Publishing Co. Ltd., Watford, Herts, England, 1971
U.S. Pat. No. 2,986,867; Berry
U.S. Pat. RE No. 27,717; Breen et al
U.S. Pat. No. 3,225,533; Henshaw
U.S. Pat. No. 3,306,023; Henshaw et al
U.S. Pat. No. 3,353,344; Clendening, Jr.
U.S. Pat. No. 3,434,275; Backer et al
U.S. Pat. No. 3,507,108; Yoshimura et al
U.S. Pat. No. 3,717,988; Walls
U.S. Pat. No. 3,775,955; Shah
U.S. Pat. No. 3,940,917; Strachan.

While this is by no means an exhaustive listing of patents or literature references on this subject, the foregoing represent references which discuss the principles and techniques which are part of the prior art.

As will be recognized from these and other references relating to this art, there are a number or problems inherent in producing yarn using self-twist techniques, these problems being related in part to the fact that the yarn tends to be relatively unstable due to the opposite twists in singles being able to cancel each other through the node area. In this regard, the above-cited U.S. Pat. No. 3,434,275 to Backer et al suggests joining regions of twist reversal. Also, in the production of self-twist yarn, the yarn tension and other parameters involved in the production are highly critical and must be closely controlled.

In Berry U.S. Pat. No. 2,986,867 a singles yarn has a unidirectional twist which may be either an "S" or "Z" twist. The twist may vary in degree and may be reversed in some portions when the singles yarn is plied into a composite plied yarn. The plying twist is derived in two steps: first a varying unidirectional ply twist is put into the yarn and then a constant uniform twist in the opposite direction is superimposed. In the plied yarn of the Berry patent the twist is in the singles yarn and the twist in the plied yarn may be in opposite directions. The sections of the plied yarn with Z ply twist can contain singles yarn of S or Z twist and similarly sections of plied yarn with S ply twist can contain singles yarn of both S and Z singles twist.

In a pile fabric, such as a pile carpet, the individual tufts are short. Consequently, a ply yarn carpet tuft of S twist with S singles would not be stable but may tend to unravel. It will not exhibit the same resistance to untwisting as a yarn of correctly balanced opposite twists. Thus, if a carpet were produced using the yarn of the Berry patent, the major portion of the carpet cut pile tufts would consist of unbalanced singles and ply twists and would not be stable. In contrast, in the yarn used in the present invention, all the yarn containing S ply twist contains Z singles and Z ply twist sections contain S twist singles.

It would not be possible to make a cut pile carpet using the process of the Berry patent which would be similar in appearance and wear characteristics to either carpet from normally spun yarn or from the pneumatic self-twist yarn as used in the present invention. A carpet made from yarn of the Berry process would have too high a proportion of the tufts which would vary in appearance, some being thin because the singles yarn twist and the ply twist are in the direction, and others being fat because of opposed single and ply twists.

A major determinant of the appearance of a carpet is the level of singles and ply twists. For example, a high-ply twist results in a frieze carpet, moderate single and ply twist results in a balanced yarn tuft of maximum resistance to untwisting, and very low ply and singles twists give high bulk and low resistance to wear. It would be very difficult using the Berry process to make a carpet of specific characteristics since the twists are all so variable and superimposed event to the extent of twist reversal.

The Shah U.S. Pat. No. 3,775,955 mentions that the composite false twist yarns "may be used to produce pile fabrics, for example, for carpets and upholstery, that are free from streaks, . . . "(col. 1, lines 6–7). The yarn in the U.S. Pat. No. 3,775,955 patent is produced by air jet vortex devices which false twist both single yarns and a plurality of yarns. That patent discusses the problem of untwisting in prior false twisted yarns and states that "application of tension normally results in still further untwisting of such prior art yarns". Twist retention is alleged to occur in the plied yarn of the U.S. Pat. No. 3,775,955 patent because, in one embodiment, there is "a stable balance between ply and single" (col. 3, lines 33–35). However, in Shah's plied yarn there is no attachment of the singles yarns at the nodes and consequently pile fabric formed from such plied yarns may still unwind or unravel when compared to the pile fabric of the present invention.

SUMMARY OF THE INVENTION

In accordance with the present invention, two or more singles yarns are twisted simultaneously in the same direction by separate primary false twist jet vortex devices. The two false-twisted yarns are brought together and joined at their nodes (where their direction of twist changes) by a yarn wheel having a rotating plying means. The single yarns will then self-twist and ply together, the direction of self-twist being opposite to the direction of the twists of the singles yarn and the self-twist being sufficient to form a stable and plied yarn. Consequently, for example, the plied yarn would consist of a repeated series of a section of S self-twisted plied yarn composed of two Z twist singles yarns, a point of plied (joined) nodes, a Z self-twist plied yarn composed of two S twist singles yarn, plied nodes, etc. The spacing between the nodes may be varied to obtain different bulk and other characteristics.

The plied yarn, using conventional machines and methods, may then be sewed into a loop carpet and the loops cut to form a pile carpet.

The increased bulk of the pile fabric of the present invention, it is believed, is due to two factors. Firstly, the jet vortex devices shoot a jet of air transverse to the direction of travel of the yarn and displace fibers out of parallelization. In contrast, conventional spinning systems promote fiber parallelization and do not increase bulk of the yarn. Secondly, the nodes, where yarns are plied together, are areas of high bulk and without twist. The ratio of such node areas to non-node areas may be selectively increased to increase the bulk of the plied yarn.

OBJECTIVES OF THE INVENTION

It is an object of the present invention to provide a pile fabric, such as a pile carpet or terry toweling, which has a relatively high bulk and is a product having a thick and luxurious appearance.

It is an object of the present invention to provide such a pile fabric which does not utilize relatively more fiber raw material than conventional pile carpets having low bulk and which is not much more costly to manufacture.

It is an object of the present invention to provide a pile carpet which does not have a streaked appearance, especially when viewed over a large area as when a potential customer views carpets.

Another object of the present invention is to provide such a pile fabric which has greater bulk than a pile fabric using ply yarns produced for use in carpets by other methods such as the ring-traveler method.

It is a further object of the present invention to provide such a pile fabric in which there is a selected ratio between carpets tufts in which (i) a selected proportion of the tufts are singles yarns which are untwisted, (ii) a selected proportion of the tufts are twisted singles yarns and the plied yarns are twisted, and (iii) a selected proportion of the tufts are singles yarns which are twisted and the plied yarns comprised of those twisted singles yarns are untwisted.

It is yet another object of the present invention to provide such a pile fabric in which the ply yarn has a selected distance between the nodes at which the yarn is plied.

It is also an object of the present invention to provide a pile fabric carpet in which the appearance and wear characteristics may be selected because the tufts utilize a plied pneumatic self-twist yarn and the tufts consist of such yarn in which the twist level (the number of turns per unit of length) may be selected and the twist is stable and balanced.

BRIEF DESCRIPTION OF THE DRAWINGS

The foregoing and other objects which are attained in accordance with this invention may be more fully comprehended from the following detailed description of particularly advantageous embodiments of the invention, taken in conjunction with the accompanying drawings.

In the drawings.

Detailed Description of the Invention

Definition of Terms

Figure 1:
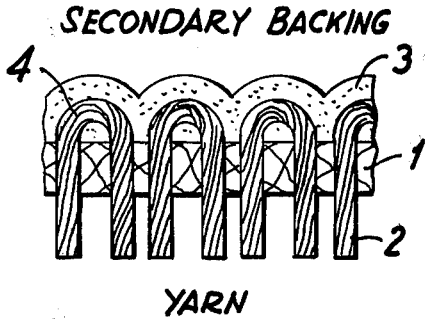
(PRIOR ART) FIG. 1
FIG. 1 is an enlarged cross-sectional view of a portion of a prior art carpet.

The fiber and fabric arts utilize a specialized terminology. That terminology, for the terms used in the present disclosure, is defined below.

The term "artificial fibers" refers to man-made fibers including cellulosic fibers such as acetate, rayon, triacetate, fibers made from synthetic polymers, such as acrylic, lastrile, modacrylic, nylon, nytril, olefin, polyester, saran, vinyl, vinylon and blends of artificial fibers with each other and with natural fibers such as cotton, linen and wool.

The term "yarn" refers to both (i) continuous strands of two or more monofilaments twisted together to form a filament yarn and (ii) yarn spun from staple, which is short lengths of filament without definite twist. A "singles yarn" is formed by a monofilament or the twisting of fibers to form an elongated strand. "Plied yarn" are two or more singles yarn strands which are twisted or otherwise joined along their lengths.

"Texturized yarn" is yarn which has been twisted or otherwise manipulated to give it bulk. The processes involved include twisting and untwisting, false twisting, crimping, knitting and deknitting.

The term "false-twist" refers to a yarn in which a yarn strand is twisted at some intermediate point generating opposite twists on either side of a "node", which is an untwisted area. In an "S-twist" helices in the twisted strands descend from left to right and in a "Z-twist" they descend from right to left.

In a "self-twist" yarn two or more false twisted strands are brought together and permitted to ply themselves. A "balanced twist" or "stable twist" means that a plied yarn, if allowed to hang freely, has no tendency to untwist in either direction.

The terms "node fixation" and "node fastening" are interchangeably used to mean a process for contacting two or more adjacent singles node areas with a rapidly rotating contact surface so as to gather fibers from each of the yarns and twist them together, thereby "fixing" or "locking" the nodes, and thus preventing rotation of the singles yarns. Such node fixation permanently preserves the singles twist, since the singles twists that are in opposite directions on either side of the nodes cannot "see" or "reach" each other and cancel through the fastened node.

"Pile" are raised loops or cut loops that form the surface of a pile fabric. A pile fabric is a fabric having tufts protruding from a backing and is distinguished from a woven fabric and a knitted fabric.

In the tufting of pile fabric and particularly carpets, generally a series of needles are positioned in a needle bar and carry the pile yarns through a backing fabric which is advanced over a throat. Oscillating loopers positioned underneath the throat engage the pile yarns and loopers may be used with or without knives to provide cut pile or uncut pile as may be desired.

"Cut-pile carpet" or "pile carpet" is a carpet made from a pile fabric and consists of tufts which may be formed from cut loops fastened into the background (backing).

"Chenille fabrics" consist of uncut loops of yarn fastened through a backing. Examples are chenille bedspreads, terry cloth and chenille rugs. "Terry cloth" is a cotton fabric, or material resembling cotton, which is covered with loops on both sides, i.e., a type of chenille fabric.

A "woven fabric" is a fabric made by interlacing two or more systems of yarns at essentially right angles to each other. Such a woven fabric has warp yarns and filling yarns intersecting and locked together. A "knitted fabric" has wales and courses interlinked in a pattern. The art of knitting consists of joining, with a single continuous thread of yarn, individual loops and joining or chaining each loop to its neighboring loops.

As shown in FIG. 1, the carpet of the prior art includes a backing material 1 which may be a woven or felt material. A plurality of cut loops tufts 2 protrude from the backing material and each tuft if held at its loop portion 4 by the backing material 1. Each tuft consists of a singles yarn of artificial fiber. The looped portions of the tufts 2 are secured by a secondary backing 3, for example, of latex.

Figure 2:
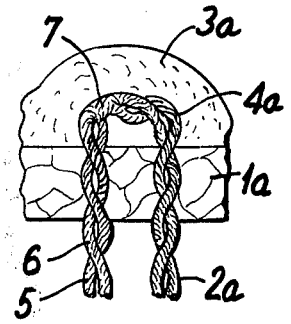
FIG. 2 is an enlarged cross-sectional view of one cut loop, consisting of two tufts, of the carpet of the present invention.

In the carpet of the present invention, shown in FIG. 2, the tufts **2*a* protrude from a backing material 1*a* and the loop portion 4*a* joining the tufts is held by the secondary backing 3*a*. In the carpet of the present invention, however, a selected portion of the tuft consists of two false-twisted singles yarns 5,6**, false-twisted in opposite S and Z directions which have been allowed to self-twist together.

The two singles yarns 5,6 have been plied at a node 7. As shown in FIG. 2, the node 7 is held within the secondary backing **3*a*. However, the nodes of other plied yarns may be within the backing 1*a* or protruding from the backing 1*a* and part of the protruding tufts 2*a***. A selected proportion of the carpet tufts, which may be all the tufts, are of the false-twist plied yarn described below.

The system described in connection with FIGS. 3–5 produces false-twist self-twist plied yarn having joined nodes. That plied yarn, after production in the system described in FIGS. 3–5, may be employed with conventional carpet-making machines to produce the carpet illustrated in FIG. 2.

Although throughout the description there are references to the use of the below-described plied yarn in carpets, it will be understood that such plied yarn may also be used to produce other types of pile fabric, for example, terry cloth, using the conventional machines and techniques applied to produce pile fabric from other types of yarn.

Figure 3:
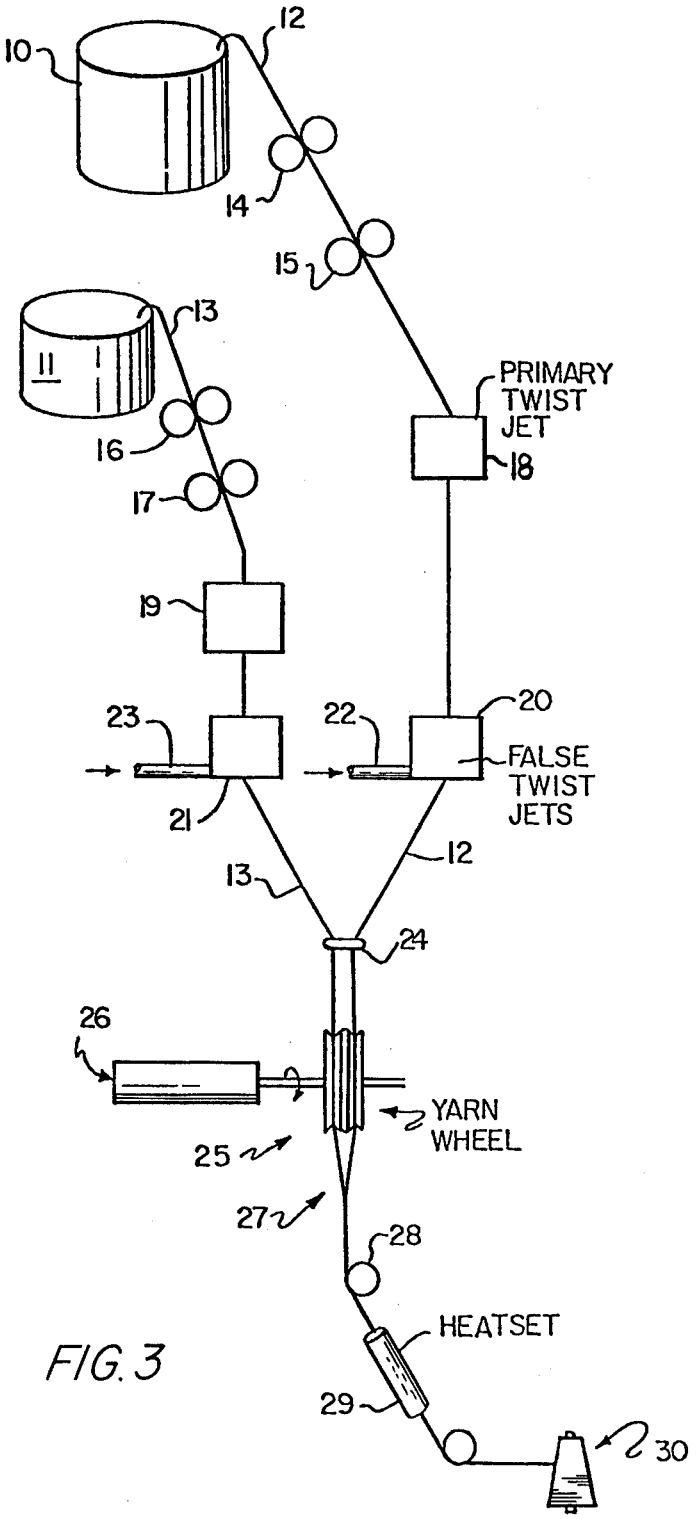
FIG. 3 is a schematic diagram of a system for forming the self-twisted yarns employed in the pile fabric according to the present invention.

As shown in FIG. 3, the system will be described commencing with the yarn strands being withdrawn from sliver containers 10 and 11, the yarn strands 12 and 13 being subjected to a drafting of drawing process by pulling the yarns between drafting rolls, yarn 12 being drawn by drafting rolls 14 and 15 and yarn 13 being drawn by drafting rolls 16 and 17. Roll 15 is typically is driven at a surface velocity greater than that of roll 14 and roll 17 is driven at a surface velocity greater than roll 16. The yarns are then passed through primary twist jets, yarn 12 being passed through primary twist jet 18 and yarn 13 being drawn through primary twist jet 19. The primary twist jets operate to impart and maintain twist at the critical point where the otherwise flat sliver ribbon leaves the drafting rolls. Yarn strands 12 is passed through a singles twist jet 20 and yarn 13 is passed through a singles twist jet 21 wherein the twist is inserted in the yarn strands. Air pressure under the control of apparatus (not shown) is supplied to false twist jets 20 and 21 through conduits 22 and 23, respectively.

Such control apparatus may be fluidic valves, electrical valves or mechanically operated valves, such apparatus being conventionally available. An example thereof is to be found at page 30 of the previously cited Henshaw text, "Self-Twist Yarn", in FIG. 3.8 (*b*). It should be noted at this stage that false twist jets 20 and 21 are paired to twist the yarn strands in the same direction as each other at the same time and are operated to periodically reverse the direction of twist. This results in two singles yarns therein, in each singles yarn, there are opposite senses of twist separated by short nodes of zero twist. The nodes are in synchronization with the yarn wheel which bears the fixation device, so that the nodes appear at the surface of the fixation device. Thus, yarn strands 12 and 13 each emerge from the respective false twist jets 20 and 21 with alternating S and Z portions of twist therein.

The two false twisted singles strands are passed through opposite sides of a generally elongated wire guide 24 which assists in maintaining the singles twist in the yarn strands and serves the purpose of bringing the yarns into a relatively closely spaced relationship, preferably not in contact with each other. The two false twisted singles yarns are guided onto a yarn wheel indicated generally at 25, the details of which will be described hereinafter. Yarn wheel 25 serves the function of guiding the two false twisted singles yarns in parallel spaced relationship with each other and fixing those yarns at their nodes by means of a rotating fixation device on the yarn wheel.

The two strands of singles yarn do not self-ply until they leave the wheel surface of yarn wheel 25, as indicated generally at 27 in FIG. 3.

The singles yarns are able to self-adjust any variations in torque between their nodes prior to such self-plying by slippage on the wheel surface of the yarn wheel 25 in the direction of rotation about their own axes, thereby equalizing the twist distribution. Two longitudinally adjacent nodes of each singles yarn are held in a fixed position on the yarn wheel and the yarn in between is not confined or restrained. The non-uniform twist of the singles yarn between each pair of nodes will distribute itself between nodes, giving a more equal distribution of twist between nodes. The yarn wheel locks each singles yarn at its nodes to the adjacent singles yarn prior to permitting the self-twist (self-plying) to occur. The method of the present invention produces a pile fabric in which the plied yarn has a much greater uniformity of twist along the distance spanning two adjacent longitudinal nodes than is possible using a prior art process which provides no means for holding singles yarns separate to allow such "leveling" of singles twist to occur, e.g., by locking the nodes after the ply twist has developed.

It will be observed that yarn twist cannot be equalized after self-plying because each cross-section in a self-twist yarn has reached a torque balance between the ply and singles twist. Once this balance occurs, no further axial rotation can occur.

As will be described hereinafter, the yarn wheel 25 is provided with a fixation device, which is a rapidly rotating contact surface, to affect locking of the nodes and the wheel is driven by a drive and control device indicated generally at 26 in synchronism with the delivery speed of the yarn and the control apparatus controlling jets 20 and 21 so that the nodes are contacted by the fixation disc on the yarn wheel.

After joining, the plied yarn is guided around a doffer roll 28 and wound or taken up by other appropriate means, or may be first passed through the continuous heat-setting apparatus indicated schematically at 29 prior to take up. Doffer roll 28 may be, for example, a turned metal wheel with a knurled or emery surface, so that is assures removal of the plied yarn from contact with the fixation device. Finally, the yarn can then be stored for future use as indicated at 30.

Figure 4:
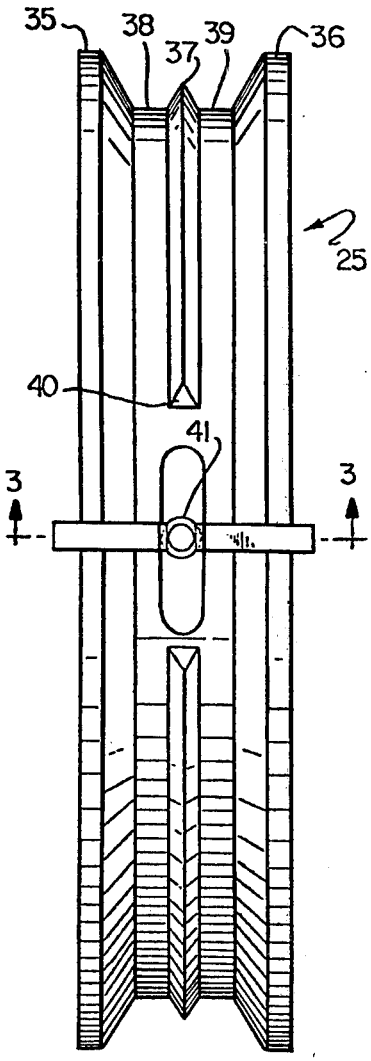
FIG. 4 is a front elevation of a yarn wheel including guide means and node fixation means forming part of the system of FIG. 3.

A first embodiment of a yarn wheel including guide means and node fixation means is indicated generally at 25 in FIG. 4. As shown therein, the wheel may be a generally disc shaped member having flanges 35 and 36 at the axial limits thereof and a central separatory flange 37, the three flanges defining peripheral surface portions 38 and 39 along which the false twist yarn strands singles are separately guided. Although wheel 25 is shown as having a single central separatory flange 37, additional separatory flanges may be provided depending on the number of false twist singles yarns being plied. The number of separatory flanges will always be one less than the number of singles yarns being plied. Central flange 37 is interrupted at 40 to permit the strands to come into close proximity with each other and also to come in contact with the contacting surface of the fixation means. The fixation means is a rapidly rotating contact surface and is an abrasion disc 41 which is rotating about an axis generally perpendicular to the axis of rotation of the yarn wheel and at a relatively high speed, on the order of 8,000 rpms. The disc 41 is driven by an electric motor which is mounted in the yarn wheel and to which D.C. voltage is supplied by means of a brush and slip ring combination. Regardless of the number of separatory flanges 37 utilized, each false twist singles yarn must be brought into contact with every other singles yarn on the disc 41 by suitable channeling means.

The abrasion disc 41 may vary in its surface contact texture depending upon the nature of the particular false-twist singles yarn being fastened. Thus, the contact surface may be relatively coarse, e.g., 30 to 100 grit, or may be relatively smooth, e.g., hard rubber of polyurethane. The contact surface of disc 41 may be treated with a material in order to increase the frictional properties of the contact surface. Additionally, the contact surface of the disc 41 may be composed of closely spaced wire pins or bristles. In general, any form of contact surface may be used which, when rotated, serves to fasten the nodes of the false twist singles yarns by locking their yarn fibers of adjacent nodes together when brought into contact with the fibers of those nodes.

Figure 5:
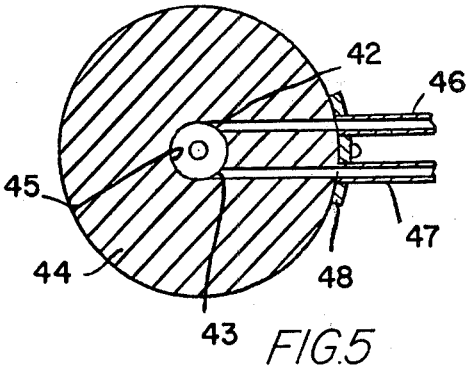
FIG. 5 is a cross-sectional view of an air vortex device forming part of the system of FIG. 3.

FIG. 5 shows an improved air vortex device, which is a jet usable in the system of FIG. 3 and in conjunction with the yarn wheel apparatus, shown in FIG. 4, to twist fibers of a singles yarn before locking and self-twisting. As illustrated in FIG. 5, a typical vortex jet can include a body 44 which is shown in cross-section in FIG. 3, the body having an elongated central bore 45 through which the yarn passes.

The central bore 45 has tangential orifices 43 and 43 intersecting the vore at diametrically opposite sides thereof. Two such jet inlets are provided to permit control of twist in either direction, as by alternately supplying the orifices with air under pressure. Air is supplied through conduits 46 or 47, which conduits are held in place by mounting means such as a plate 48 to which the conduits are attached, the plate being attached to the jet as by screws or similar fastening means.

What is claimed is:

1. A pile fabric comprising a backing and a plurality of tufts protruding from said backing, a selected proportion of said tufts consisting of self-twist plied yarn, said self-twist plied yarn consisting of a plurality of false twisted singles yarns, each singles yarn having a repeating pattern along its length of S twist and Z twist and nodes therebetween, said singled yarns being fastened together at said nodes and having the same direction of twist between said nodes, said self-twisted plied yarn being self-twisted in opposite directions to said singles yarns, and the remainder of said tufts consisting of substantially untwisted singles yarn in unplied yarn.

2. A pile fabric as recited in claim 1 wherein the fabric is a cut-pile carpet.

3. A pile fabric as recited in claim 1 wherein the fabric is a loop-pile carpet.

4. A pile fabric as recited in claim 1 wherein said fabric is a terry toweling.

5. A pile fabric as in claim 1 wherein said completed fabric is used as wall covering.

6. A pile fabric as in claim 1 wherein said fabric is used as furniture upholstery.

7. A pile fabric as in claim 1 wherein said tufts are a blend of artificial and natural fibers.

8. A pile fabric as in claim 2 wherein said tufts are a blend of artificial and natural fibers.

9. A pile fabric as recited in claim 3 wherein said tufts are a blend of artificial and natural fibers.

* * * * *